US009339089B2

(12) United States Patent
So

(10) Patent No.: US 9,339,089 B2
(45) Date of Patent: May 17, 2016

(54) STRING LENGTH ADJUSTING DEVICE

(76) Inventor: Youn-Seo So, Yongin-si (KR)

( * ) Notice: Subject to any disclaimer, the term of this patent is extended or adjusted under 35 U.S.C. 154(b) by 215 days.

(21) Appl. No.: 14/119,886

(22) PCT Filed: May 24, 2012

(86) PCT No.: PCT/KR2012/004106

§ 371 (c)(1),
(2), (4) Date: Nov. 25, 2013

(87) PCT Pub. No.: WO2012/165803

PCT Pub. Date: Dec. 6, 2012

(65) Prior Publication Data

US 2014/0097283 A1 Apr. 10, 2014

(30) Foreign Application Priority Data

May 30, 2011 (KR) ..... 10-2011-0051381

(51) Int. Cl.
*B65H 75/48* (2006.01)
*A44B 99/00* (2010.01)
*A43C 11/16* (2006.01)

(52) U.S. Cl.
CPC ..... *A44B 99/00* (2013.01); *A43C 11/165* (2013.01)

(58) Field of Classification Search
USPC ..... 242/378.1
See application file for complete search history.

(56) References Cited

U.S. PATENT DOCUMENTS 7,367,522 B2 * 5/2008 Chen ..... A43C 7/00 24/68 SK
7,900,670 B2 * 3/2011 McCauley ..... B60C 27/10 152/217
8,231,074 B2 * 7/2012 Hu ..... A43C 11/165 24/68 SK
8,353,087 B2 * 1/2013 Chen ..... A43C 11/165 24/68 SK
8,434,200 B2 * 5/2013 Chen ..... A43C 11/165 2/418
8,468,657 B2 * 6/2013 Soderberg ..... A43C 11/16 24/68 SK
8,832,912 B2 * 9/2014 Ha ..... A43C 11/165 24/68 B
8,858,482 B2 * 10/2014 Ingimundarson ..... A61F 5/0111 128/882
9,072,341 B2 * 7/2015 Jungkind ..... A43C 11/165
2007/0295850 A1 * 12/2007 Lin ..... B65H 75/4434 242/378.1
2008/0066346 A1 3/2008 Hammerslag et al.
2009/0039191 A1 2/2009 Yen
2010/0251524 A1 10/2010 Chen
2011/0266384 A1 * 11/2011 Goodman ..... A43C 11/165 242/396.4
2014/0290014 A1 * 10/2014 Myrick ..... A43C 11/165 24/712.2

FOREIGN PATENT DOCUMENTS

JP 3098502 U 10/2003
JP 3108039 U 1/2005
JP 3159620 U 4/2014
KR 10-0929587 B1 12/2009
KR 10-0959800 B1 5/2010
WO 2010/147330 A2 12/2010
WO 2011/025243 A2 3/2011

* cited by examiner

*Primary Examiner* — Emmanuel M Marcelo
*Assistant Examiner* — Angela K Caligiuri
(74) *Attorney, Agent, or Firm* — Revolution IP, PLLC

(57) ABSTRACT

Disclosed is a string length adjusting device, which includes a fixed housing including a drum rotation shaft formed in a central region thereof; a rotation housing rotatably coupled with respect to the fixed housing; a winding drum inserted into the fixed housing and the rotation housing and including a winding part around/from which a string is wound or unwound; and a coupling unit guide shaft coupling the fixed housing to the rotation housing, the coupling unit guide shaft guiding up/down operations of the rotation housing for operations of winding or unwinding the string.

15 Claims, 5 Drawing Sheets

STRING LENGTH ADJUSTING DEVICE

CROSS REFERENCE TO PRIOR APPLICATIONS

This application is a National Stage Application of PCT International Patent Application No. PCT/KR2012/004106 filed on May 24, 2012, under 35 U.S.C. §371, which claims priority to Korean Patent Application No. 10-2011-0051381 filed on May 30, 2011, which are all hereby incorporated by reference in their entirety.

TECHNICAL FIELD

The present invention relates to a string length adjustment device, and more particularly, to a string length adjustment device with an improved structure that reduces the number of components when compared to that of the conventional string length adjustment device and significantly enhances the ease of assembly and operational stability of the device, thereby reducing the production unit cost and the rate of failure and more conveniently and effectively adjusting the string length.

BACKGROUND ART

Shoes such as sneakers, bags, or clothes such as sweat suits, hats or the like are generally provided with adjustment strings (hereinafter, referred to as 'string') for adjusting the waist size or head size to be fit into users' bodies after the users put them on or if necessary. The string typically has a fixation clip moving along the string at an end of the string so as to keep the length of the string constant.

The clip acts to prevent the string from being moved along the string in close contact with the string when the string passes through the central portion of the clip, and allows the close contact to be released and moved along the string again by means of a press operation of the user, thereby adjusting the length and shape of the clothes or hats to suit user's taste.

However, the clip inconveniently causes the user to individually and separately adjust the string length at the time of adjusting the length.

In addition, an extra string may get in the way or may be entangled while the entire length of the string keeps the same. It is also difficult to separate the string from the clip, so that the clip may hit the inside of the washing machine to cause the washing machine to be damaged or may cause the clothes or the washing machine to be damaged at the time of washing the clothes.

In view of the foregoing, the present inventors have proposed the string length adjustment device that can solve the problems associated with the clip described above and are notified of Korean Patent Registration No. 929587.

Korean Patent Registration No. 929587 relates to the string length adjustment device in which a coupling unit consisting of an elastic spring, a cap and a bolt is fixed to a lower portion of a coupling unit guide shaft (drum rotation axis) of a winding drum, and a rotation housing can be rotated in either forward or reverse direction when the cap is disposed in an upper region of the spring by virtue of the spring operation and can be rotated only in one direction when the cap is disposed in a lower region of the spring.

However, in the case of the string length adjustment device, the coupling unit guide shaft of the winding drum should be typically made of metal in order to ensure the durability of the device, and the manufacturing unit cost of the string length adjustment device may be increased and the string length adjustment device may be failed due to spring deformation or deviation. In addition, since the winding portion around/from which the string is wound/unwound is integrally formed with the rotation housing and operates together all the time, the string may be entangled within the device to cause the device to be out of control or to cause the device itself to be damaged when the user arbitrarily rotates the knob (rotation housing or housing cap) in an excessive or forcible way in the unwinding direction without pulling and loosely untying the string of shoes in the unwinding state.

The present inventors have therefore invented and proposed a novel string length adjustment device by not using components such as metallic coupling unit guide shafts, adjustable curve-type elastic springs, or the like to thereby reduce the product unit cost and improve the assembly and also by improving the structure of the device such that the rotation housing and the winding drum are integrally rotated in one direction in the winding state and only the winding drum is rotated in either forward or reverse direction in the unwinding state to thereby enhance the operational stability and reduce the rate of failure.

SUMMARY OF INVENTION

Technical Problem

It is an object of the present invention to provide a string length adjustment device with an improved structure that reduces the number of components when compared to that of the conventional string length adjustment device and significantly enhances the ease of assembly and operational stability of the device, thereby reducing the production unit cost and the rate of failure and more conveniently and effectively adjusting the string length.

Solution to Problem

The purpose mentioned above is achieved by the string length adjustment device, which includes: a fixed housing including a drum rotation axis formed in a central region thereof; a rotation housing rotatably coupled with respect to the fixed housing; a winding drum inserted into the fixed housing and the rotation housing and including a winding part around/from which a string is wound or unwound; and a coupling unit guide shaft coupling the fixed housing to the rotation housing, the coupling unit guide shaft guiding up/down operations of the rotation housing for operations of winding or unwinding the string.

Unidirectional sawteeth may be disposed in any one of the fixed housing and the rotation housing in the direction in which the fixed housing and the rotation housing are coupled with each other, latches interacting with the unidirectional sawteeth by being selectively engaged with the unidirectional sawteeth so as to allow the string to be wound around or unwound from the winding drum may be disposed in the other of fixed housing and the rotation housing in which the unidirectional sawteeth are not formed, housing coupling sawteeth may be disposed in an annular shape in a lower region of the rotation housing, and drum coupling sawteeth interacting with the housing coupling sawteeth by being engaged with the housing coupling sawteeth may be disposed in an annular shape in an upper region of the winding drum.

The housing coupling sawteeth and the drum coupling sawteeth may be provided in the form of right triangle or obtuse triangle, and the housing coupling sawteeth and the drum coupling sawteeth may be engaged with each other such that oblique sides are in contact with the respective corresponding sides and sides forming heights are in contact with the respective corresponding sides forming heights.

Each of the coupling sawteeth may have a flexibility allowing the coupling sawtooth to be elastically moved when an external force is applied to the coupling sawtooth.

When the rotation housing is pressed downward to allow the string to be wound, the latches may be engaged with the unidirectional sawteeth, the rotation housing may be rotated only in one direction, the housing coupling sawteeth of the rotation housing and the coupling sawteeth of the winding drum may be firmly in close contact with each other to cause the winding drum to be integrally rotated when the rotation housing is rotated.

When the rotation housing is pulled upward to allow the string to be unwound, the latches may be engaged with or spaced apart from the unidirectional sawteeth, the rotation housing may be rotated in one direction or can be rotated in either forward or reverse direction, and the housing coupling sawteeth of the rotation housing and the coupling sawteeth of the winding drum may be completely spaced from each other so that an interference state is removed.

Elastic ribs elastically biased in an outward radial direction may be provided in the coupling unit guide shaft, protrusions may be formed on the elastic ribs, and protrusion supports that support the protrusions and are selectively positioned may be formed on walls of a shaft insertion hole of the rotation housing.

Elastic restoration reinforcing portions for reinforcing the elastic restoration of the elastic ribs may be further provided in the elastic ribs.

The drum coupling sawteeth may include first drum coupling sawteeth shaped to allow the housing coupling sawteeth of the rotation housing to be rotated in either forward or reverse direction; and second drum coupling sawteeth disposed in lower regions of the first drum coupling sawteeth and shaped to be engaged with the housing coupling sawteeth so as to allow the rotation housing and the winding drum to be integrally rotated.

The protrusions of the coupling unit guide shaft may be disposed in upper positions with the protrusion supports being interposed therebetween when the rotation housing is pressed toward the fixed housing so as to wind the string, and may be disposed in lower positions with the protrusion supports being interposed therebetween when the rotation housing is pulled upward so as to unwind the string.

The unidirectional sawteeth may be formed along an inner peripheral surface, an outer peripheral surface, or the top surface, and may be shaped to allow the latches to be rotated in one direction.

Free ends of the latches may be shaped to be hooks that may be elastically moved toward the inside of the radial direction or upward out of the top surface.

Two circular plates for maintaining the string position may be disposed to be spaced from each other in the winding drum.

The coupling unit guide shaft may include a shaft and a screw, the shaft may be inserted from the rotation housing side and into the rotation axis of the fixed housing to prevent up/down movements of the winding drum, and the screw may enable the rotation axis of the fixed housing and the shaft to be coupled and fixed to each other.

The rotation housing may further include a number of individual latches and latch guides for guiding the individual latches, and the individual latches may be separately made to be engaged with the sawteeth of the fixed housing side and may be coupled to the rotation housing side.

Each of the individual latches may include a first latch interacting with the sawtooth of the fixed housing side by being engaged with the sawtooth, and a second latch integrally formed with the first latch, formed to have a smaller thickness than the first latch at one side of the first latch for providing the first latch with elastic restoration, and supported by the latch guide.

An individual latch deviation blocking portion may be further formed on an inner wall of the latch guide and is disposed between the first latch and the second latch to prevent the individual latches from being deviated.

Advantageous Effects of Invention

According to the present invention, the number of components of the string length adjustment device can be reduced when compared to that of the conventional string length adjustment device and the ease of assembly and operational stability of the device can be significantly enhanced, thereby reducing the production unit cost and the rate of failure and more conveniently and effectively adjusting the string length.

BEST MODE OF CARRYING OUT THE INVENTION

Figure 1:
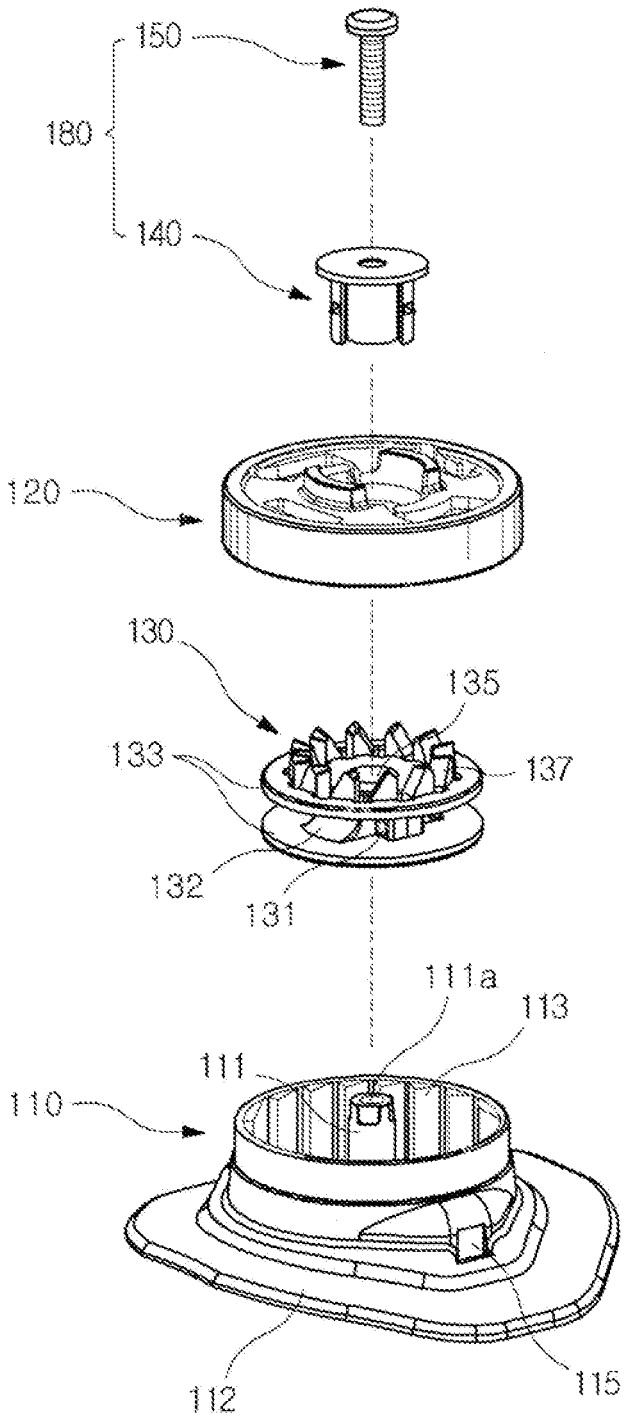
FIG. 1 is a disassembled perspective view illustrating a string length adjustment device in accordance with a first embodiment of the present invention.

Hereinafter, embodiments of the present invention will be described in detail with reference to accompanying drawings so as to allow those skilled in the art to readily carry out the invention. The present invention may be implemented in various different forms and are not limited to the embodiments described herein. To clearly describe the present invention, portions that are not related to the description are omitted and identical or similar components are denoted with the same reference numerals throughout the description.

Before starting to describe the invention with reference to the drawings, the term 'string' used hereinafter may include a lace made of various materials and provided in shoes, bags, jumpers, sweat suits, hats, or may include headphone wires, earphone wires, MP3 strings, necklace strings, computer wires, or the like. However, these examples are not differentiated and are described as the 'string.'

Figure 2:
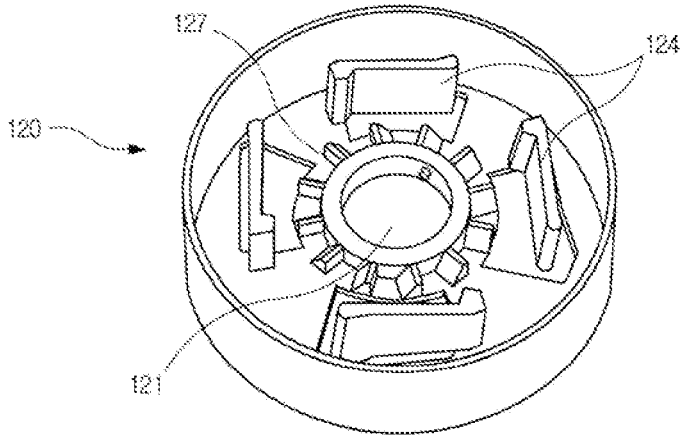
FIG. 2 is a bottom perspective view illustrating a rotation housing shown in FIG. 1.
Figure 3:
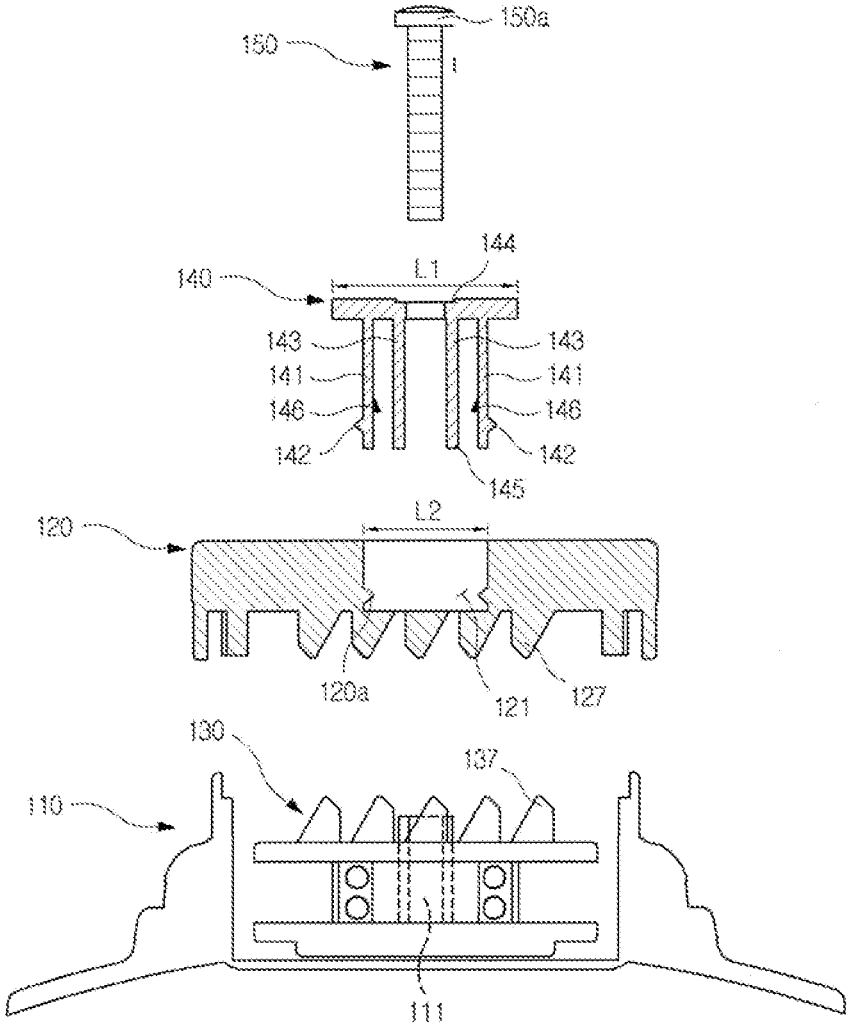
FIG. 3 is a partial cross-sectional view of FIG. 1.
Figure 4:
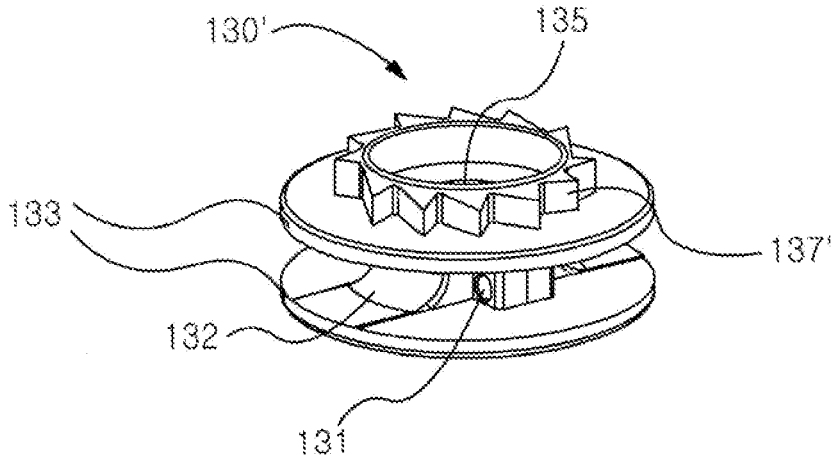
FIGS. 4 and 5 are variants of winding drums.
Figure 5:
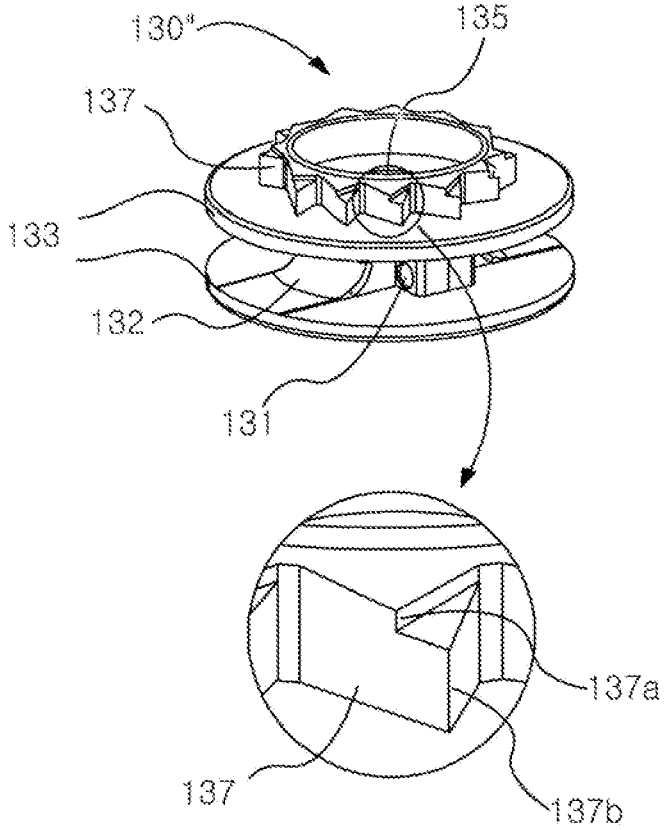

FIG. 1 is a disassembled perspective view illustrating a string length adjustment device in accordance with a first embodiment of the present invention, FIG. 2 is a bottom perspective view illustrating a rotation housing shown in FIG. 1, FIG. 3 is a partial cross-sectional view of FIG. 1, and FIGS. 4 and 5 are variants of winding drums.

As shown in these drawings, the string length adjustment device according to the first embodiment of the present invention includes a fixed housing 110 having a drum rotation axis 111 formed at a central region of the fixed housing, a rotation housing 120 rotatably coupled with respect to the fixed housing 110, a winding drum 130 inserted into the fixed housing 110 and the rotation housing 120 and having a winding part 132 around/from which a string is wound or unwound, and a coupling unit guide shaft 180 coupling the fixed housing 110 to the rotation housing 120 and guiding up/down operations of the rotation housing 120 for operations of winding or unwinding the string. The coupling unit guide shaft 180 may consist of a shaft 140 and a screw 150, the shaft is inserted from the rotation housing 120 side and into the rotation axis formed at a central portion of the fixed housing 110 to prevent up/down movements of the winding drum 130, and the screw enables the rotation axis of the fixed housing 110 and the shaft 140 to be coupled and fixed to each other.

As described above, the string length adjustment device of the present embodiment is used by assembling five components such as the fixed housing 110, the rotation housing 120, the winding drum 130, the shaft 140, and the screw 150. The number of components is thus reduced when compared to that of the conventional string length adjustment device (not shown) and the ease of assembly and operational stability of the device are significantly enhanced, thereby reducing the production unit cost and the rate of failure and more conveniently and effectively adjusting the string length. Each of the components will be described.

The fixed housing 110 along with the rotation housing 120 provides a space that allows the winding drum 130 to be accommodated therein.

After the winding drum 130 is received in the fixed housing 110, the drum rotation axis 111 rotatably coupled to the winding drum 130 is provided in a central region of the fixed housing 110 so as to allow the winding drum 130 to be rotated within the fixed housing 110. A screw thread 111*a* to be engaged with the screw 150 is formed on an inner wall of the drum rotation axis 111.

A fixation flange 112 for fixing the fixed housing 110 to shoes, bags, or the like is formed at a bottom surface of the fixed housing 110. The bottom surface of the fixed housing 110 may be fixed to shoes, bags, or the like by means of the fixation flange 112.

As described above, the string length adjustment device of the present embodiment may be mounted in the form of several assembled components by fixing the fixed housing 110 to shoes, bags, or the like and coupling the rotation housing 120 to the fixed housing 110. The maintenance operation can thus be facilitated by detaching the fixed housing 110 from shoes, bags, or the like and replacing the fixed housing with new one at the time of maintenance.

A string penetrating hole 115 is formed at a side of the fixed housing 110 to allow the string to penetrate the hole to be wound around the winding drum 130 or unwound from the winding drum 130. A pair of the string penetrating hole 115 is preferably provided at symmetrical positions.

However, the scope of the present invention is not limited thereto. Accordingly, the number of the string penetrating hole 115 may be one or three or more, and the positions may be different from the position shown in FIG. 1.

The rotation housing 120 is a component grabbed and rotated by a user at the time of operating the string length adjustment device.

The string may be wound around the winding drum 130 or unwound from the winding drum 130 by rotating the rotation housing 120 in one direction with respect to the fixed housing 110 fixed to shoes, bags, or the like.

The rotation housing 120 has a circular plate shape with a constant height (thickness), and a shaft insertion hole 121 allowing the coupling unit guide shaft 142 to be inserted therethrough is formed in a central region of the rotation housing.

Latches 124 interacting with unidirectional sawteeth 113 of the fixed housing 110 side to be described later by being selectively engaged with the unidirectional sawteeth are provided in an inner lower region of the rotation housing 120. The latches 124 may have free ends that are formed to have a hook shape and are elastically movable toward the inside or outside of the radial direction.

Four latches 124 are spaced from each other in the circumferential direction of the rotation housing 120 in the present embodiment. However, the scope of the present invention is not limited thereto. Accordingly, the number and position of the latches 124 may be variously changed.

A plurality of housing coupling sawteeth 127 are provided in an annular shape around the shaft insertion hole 121 between the shaft insertion hole 121 and the latches 124 formed in the lower region of the rotation housing 120. Each of the housing coupling sawteeth 127 has a general right triangle shape, and may be an obtuse triangle of which one interior angle is an obtuse angle.

The housing coupling sawteeth 127 may be formed in the lateral position different from the position shown in the drawings. As shown in the corresponding winding drum 130' of FIG. 4, a plurality of drum coupling sawteeth 137 interacting with the housing coupling sawteeth 127 of the rotation housing 120 by being engaged with the housing coupling sawteeth are formed in an annular shape in the upper region (coupling portion of the rotation housing 120) of the winding drum 130'.

When the housing 120 and the drum coupling sawteeth 127 and 137 of the triangle shape are engaged with each other, oblique sides are in contact with the respective corresponding sides and sides forming heights are in contact with the respective corresponding sides forming heights.

In the meantime, when the housing coupling sawteeth 127 of the rotation housing 120 are in close contact with the drum coupling sawteeth 137 of the winding drum 130 to rotate the rotation housing 120 in a state in which the rotation housing 120 is pressed downward to allow the winding operation of the string length adjustment device, that is, in a state in which the latches 124 are engaged with the unidirectional sawteeth 113 to allow the rotation housing 120 to be rotated only in one direction, the winding drum 130 is integrally rotated.

In a state in which the rotation housing 120 is pulled upward to allow the unwinding operation of the string length adjustment device, that is, in a state in which the latches 124 are engaged with or spaced from the unidirectional sawteeth 113 to allow the rotation housing 120 to be rotated in one direction or forward/reverse direction, the coupling sawteeth 127 and 137 are completely spaced from each other, thereby having no interference.

Unidirectional sawteeth 113 formed in the thickness (height) direction of the fixed housing 110, that is, in the direction in which the fixed housing 110 and the rotation housing 120 are coupled to each other, are provided in an inner peripheral surface of the upper region of the fixed housing 110 (see FIG. 1). The unidirectional sawteeth 113 may be processed to have a shape allowing only unidirectional rotation.

As a result, when the latches 124 of the rotation housing 120 are engaged with the unidirectional sawteeth 113, the rotation housing is rotated only in either forward or reverse direction. This is possible by means of the sawteeth shape of the unidirectional sawteeth. When the latches 124 of the rotation housing 120 having the structure described above are engaged with the unidirectional sawteeth 113, the string may be wound by rotation in any one direction, and may be unwound when the rotation housing 120 is pulled upward.

The unidirectional sawteeth 113 are described to be provided in the inner peripheral surface of the upper region of the fixed housing 110 in the present embodiment. However, since the unidirectional sawteeth 113 may be provided in the outer peripheral surface of the upper region of the fixed housing 110, the scope of the present invention is not limited to the shape shown in the drawing. That is, the unidirectional sawteeth 113 may be provided in the top surface of the fixed housing 110.

In addition, the position in which the unidirectional sawteeth 113 are provided is not limited to the fixed housing 110. The unidirectional sawteeth may be provided at a side of any one of the fixed housing 110 and the rotation housing 120 in the direction in which the fixed housing 110 and the rotation housing 120 are coupled to each other. Accordingly, the latches 124 interacting with the unidirectional sawteeth 113 by being selectively engaged with the unidirectional sawteeth may be provided in the other in which the unidirectional sawteeth 113 are not provided.

The winding drum 130 is a component around/from which the string is actually wound or unwound, and is inserted into the fixed housing 110 and the rotation housing 120.

In particular, as shown in FIG. 1, the winding drum 130 has the winding part 132 around/from which the string is actually wound or unwound, and a pair of string penetrating holes 131 through which the string is penetrated are formed at symmetrical positions in the winding part 132. The string penetrating holes 131 may be formed as a separate structure in any one portion of the winding part 132 as shown in FIG. 1, or may be formed by penetrating the winding part 132 (not shown).

The string forms a path by being introduced into the fixed housing 110 through one of the string penetrating holes 115, passing through the string penetrating holes 131 of the winding drum 130, being wound around the winding part 132, and exiting the fixed housing 110 through the other of the string penetrating holes 115 of the fixed housing 110.

In addition, two (i.e., a pair of) circular plates 133 for maintaining the string position while blocking upward or downward movements of the string being wound or unwound are coupled to and spaced from each other with the winding part 132 being provided therebetween in the winding drum 130. Operations are not influenced even when the circular plates 133 are not be provided. However, when the circular plates 133 are coupled to each other, the position in which the string is wound may be constant, thereby eliminating the problem that the string is twisted or pressed upward or downward to cause an interruption to the operation.

The winding drum 130 has a via hole 135 that penetrates the central top and bottom regions of the fixed housing so as to be inserted into the drum rotation axis 111 of the fixed housing 110.

A plurality of drum coupling sawteeth 137 interacting with the housing coupling sawteeth 127 of the rotation housing 120 by being engaged with the respective housing coupling sawteeth are provided in an annular shape around the via hole 135 in the upper region of the winding drum 130 (the portion coupled with the rotation housing 120).

Each of the drum coupling sawteeth 137 has a general right triangle shape in the same way as the housing coupling sawteeth 127, and may be a right triangle of which one interior angle is a right angle or an obtuse triangle of which one interior angle is an obtuse angle.

In addition, the drum coupling sawteeth 137 may have a shape in which the generally triangular sawteeth are protruded upward as shown in FIG. 1. However, the drum coupling sawteeth may have a shape in which generally triangular sawteeth 137' are protruded in a horizontal direction as shown in the winding drum 130' of FIG. 4, if necessary.

The string length adjustment device according to the second embodiment of the present invention may be formed with first drum coupling sawteeth 137*a* and second drum coupling sawteeth 137*b* shaped to be different from each other as is done in the winding drum 130" of FIG. 5. In this case, as in another embodiment shown in FIG. 6, the first drum coupling sawteeth 137*a* are shaped to allow the coupling winding latches 127' of the rotation housing 120 to be rotated in either forward or reverse direction (clockwise or counterclockwise direction), and the second drum coupling sawteeth 137*b* are processed to be engaged with the respective coupling winding latches 127' or are processed in one direction.

The first drum coupling sawteeth 137*a* are disposed to be higher than the second drum coupling sawteeth 137*b*. The rotation housing 120 may be rotated in either forward or reverse direction by means of the first drum coupling sawteeth 137*a* when the coupling winding latches 127' of the rotation housing 120 are disposed in and engaged with the first drum coupling sawteeth 137*a*, and the winding drum 130 can be rotated integrally together with the rotation housing 120 when the coupling winding latches 127' of the rotation housing 120 are disposed in and engaged with the second drum coupling sawteeth 137*b*.

According to the two-stage structure of the drum coupling sawteeth 137 (i.e., the first and second drum coupling sawteeth) described above, the rotation housing 120 may be rotated in one direction (winding direction0 to wind the string when the coupling winding latches 127' of the rotation housing 120 are engaged with the second drum coupling sawteeth 137*b* of the winding drum 130, and the string may be unwound from the winding drum 130 by pulling the string when the coupling winding latches 127' are engaged with the first coupling sawteeth 137*a*.

In a state in which unwinding is possible, the coupling winding latches 127' of the rotation housing 120 and the first drum coupling sawteeth 137*a* are weakly interfered with each other. In this state, rotation of the rotation housing 120 goes through a weak resistance from the first drum coupling sawteeth 137*a* but may be rotated in either forward or reverse direction. The winding drum 130 may maintain the stopped state regardless of the rotation of the rotation housing 120 even when the rotation housing 120 is rotated in either forward or reverse direction.

Accordingly, the winding drum 130 is not rotated even when the user excessively and arbitrarily rotates the rotation housing 120 in the winding direction without pulling the string in the unwinding state to make the string of the shoes loose, thereby preventing the string from being tangled within the string length adjustment device or preventing the device itself from being damaged.

In addition, when the user pulls the string in the unwinding state, the string is not untied without any resistance but untied smoothly by the weak resistance with the coupling winding latches 127' at the time of rotation of the winding drum 130 because the weak resistance exists between the first drum coupling sawteeth 137*a* and the coupling winding latches 127', thereby enhancing a sense of use.

In the meantime, the shaft 140 is partially coupled to the central region of the rotation housing 120 and serves to guide up/down operations of the rotation housing 120 for operations of winding or unwinding the string as shown in FIG. 3. The screw 150 is engaged with the screw thread 111*a* of the drum rotation axis 111 through the shaft 140 from the outside of the rotation housing 120.

To enable the rotation housing 120 to be moved upward or downward with the shaft 140 being used as a axis, protrusions 142 are formed on elastic ribs 141 that are elastically biased in the outward radial direction, and protrusion supports 120*a* that support the protrusions 142 and are selectively positioned are formed on walls of the shaft insertion hole 121 of the rotation housing 120. That is, the protrusion supports 120*a* may be disposed in the upper or lower positions with the protrusion 142s being interposed therebetween.

Alternatively, first and second protrusion insertion grooves (not shown) in the form of groove into which the protrusions 142 are selectively inserted may be formed instead of the protrusion supports 120*a*.

The protrusions 142 of the shaft 140 may be disposed in the upper position with the protrusion supports 120*a* being interposed therebetween when the rotation housing 120 is pressed toward the fixed housing to wind the string, and the protrusions 142 of the shaft 140 may be disposed in the lower position with the protrusion supports 120*a* being interposed therebetween when the rotation housing 120 is pulled to unwind the string.

The elastic ribs 141 are made to have a property allowing the elastic ribs to be elastically expanded in the outward radial direction all the time, and serves to increase the coupling strength between the rotation housing 120 and the shaft 140. The protrusion supports 120*a* can thus be prevented from being deviated from the position below or above the protrusions 142.

A screw passing boss 143 through which the screw 150 passes is formed in the central region of the shaft 140, and a position groove 144 in which a head 150*a* of the screw 150 is positioned is formed on a top surface of the shaft 140. The position groove 144 prevents the head 150*a* of the screw 150 from being exposed and thus degrading the beauty of appearance.

In the meantime, the upper portion length L1 of the shaft 140 needs to be longer than the diameter L2 of the shaft insertion hole 121 of the rotation housing 120 so as to prevent the rotation housing 120 from being deviated upward. In addition, when the rotation housing 120 is pulled upward, the length may act to allow the internal cylindrical portion 145 of the shaft 140 to press the winding drum 130 so that the winding drum 130 is not pulled along with the rotation housing. Elastic restoration reinforcing portions 146 for reinforcing elastic restoration of the elastic ribs 141 are further provided in the elastic ribs 141. The elastic restoration reinforcing portions 146 are illustrated to be protruded in the drawing. However, the scope of the present invention is not limited thereto.

When the string is first intended to be wound around the winding drum 130 by the configuration described above, the rotation housing 120 is pressed toward the fixed housing 110 (downward). As a result, the latches 124 are engaged with the unidirectional sawteeth 113 while the coupling winding latches 127' are engaged with the second drum coupling sawteeth 137*b* of the winding drum 130, and the protrusions 142 of the shaft 140 are disposed in the upper position with the protrusion supports 120*a* being interposed therebetween. In this case, the user may wind the string while rotating the rotation housing 120 or the housing cap 160 in one direction (winding direction).

On the other hand, when the string is intended to be unwound from the winding drum 130, the rotation housing 120 is pulled in opposite direction to the fixed housing 110, that is, the upward direction. As a result, the latches 124 are engaged with the unidirectional sawteeth 113 while the coupling winding latches 127' and the first drum coupling sawteeth 137*a* of the winding drum 130 are disengaged from each other or go through the mutually weak interference, and the protrusions 142 of the shaft 140 are disposed in the lower position with the protrusion supports 120*a* being interposed therebetween. In this state, the user may pull the string and unwind the string from the winding drum 130 to make the length of the string loose.

As described above, according to the present invention, the number of components of the string length adjustment device can be reduced when compared to that of the conventional string length adjustment device and the ease of assembly and operational stability of the device can be significantly enhanced, thereby reducing the production unit cost and the rate of failure and more conveniently and effectively adjusting the string length.

Figure 6:
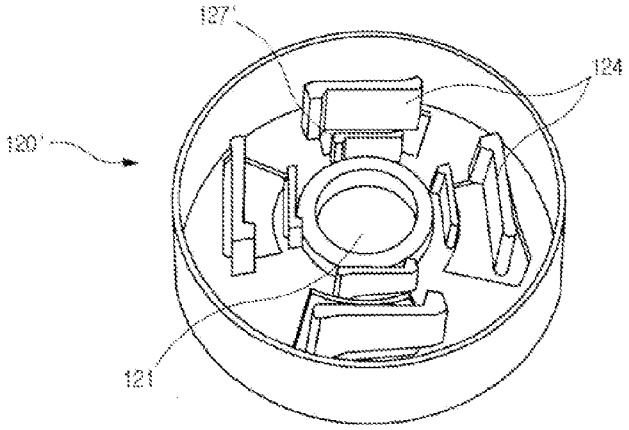
FIG. 6 is a planar structural view schematically illustrating a rotation housing that may correspond to the winding drum of FIG. 5 of a string length adjustment device in accordance with a second embodiment of the present invention.

FIG. 6 is a planar structural view schematically illustrating the rotation housing that may correspond to the winding drum of FIG. 5 of the string length adjustment device in accordance with a second embodiment of the present invention.

Although briefly described above, several coupling winding latches 127' shown in FIG. 6 may be formed in the rotation housing 120' that may be applied to the winding drum 130" of FIG. 5.

The coupling winding latches 127' may correspondingly interact with the first drum coupling sawteeth 137*a* and the second drum coupling sawteeth 137*b*. Although four coupling winding latches 127' are shown in the drawing, two, three, or five or more are also possible.

Figure 7:
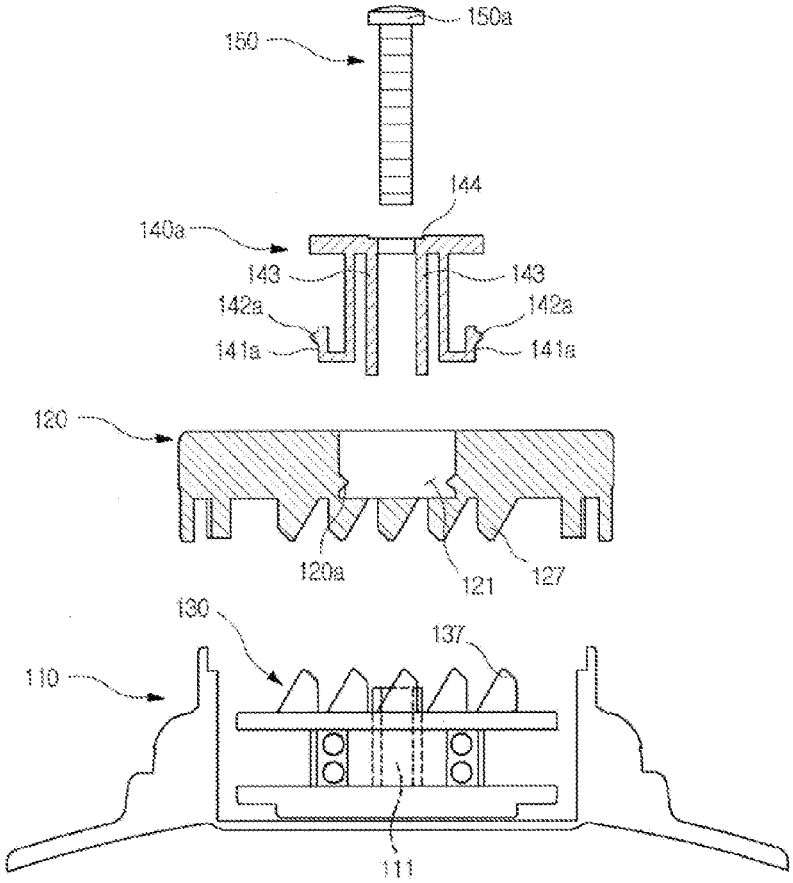
FIG. 7 is a partial cross-sectional view illustrating a string length adjustment device in accordance with a third embodiment of the present invention.

FIG. 7 is a partial cross-sectional view illustrating a string length adjustment device in accordance with a third embodiment of the present invention.

Although the elastic ribs 141 of the shaft 140 are made to be linear in the embodiment described above, elastic ribs 141*a* of the coupling unit guide shaft 140*a* are made to be partially bent in FIG. 7 and the protrusions 142*a* are formed outside the bent elastic ribs 141*a* in the present embodiment.

According to the configuration shown in FIG. 7, more elasticity may be given by virtue of the structural shape of the elastic ribs 141*a* themselves, thereby reducing the disassembling phenomenon.

Figure 8:
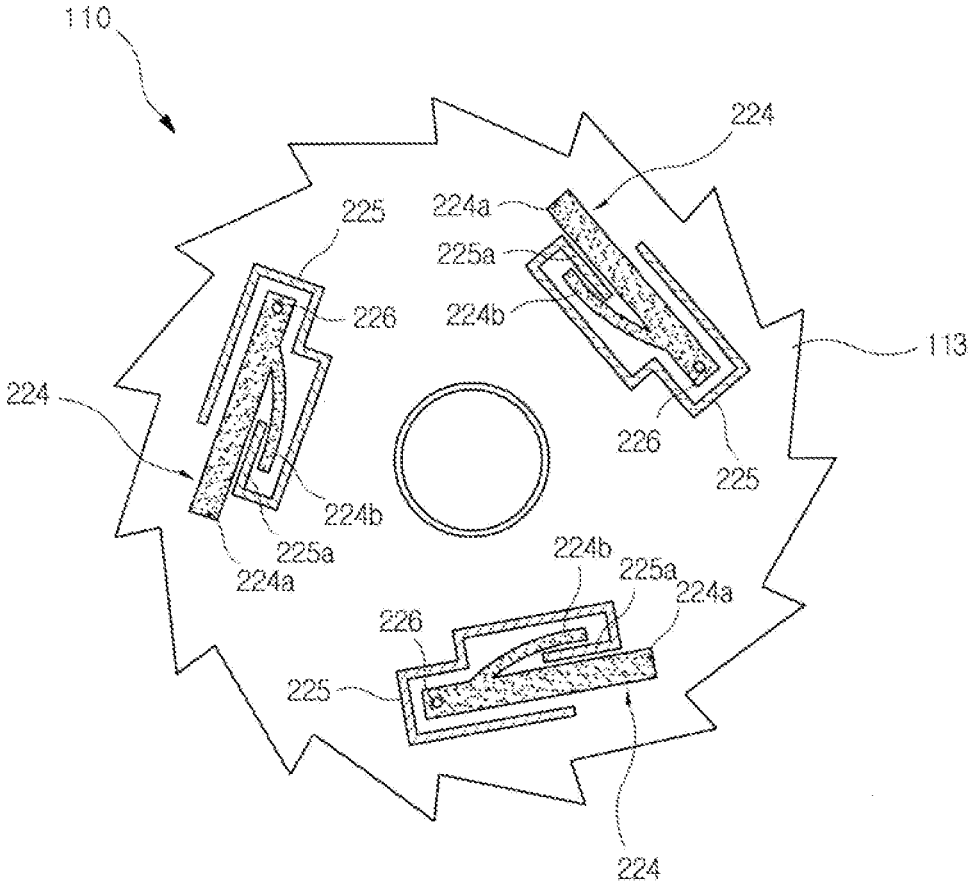
FIG. 8 is an enlarged structural view illustrating a main part of a string length adjustment device in accordance with a fourth embodiment of the present invention.

FIG. 8 is an enlarged structural view illustrating a main part of a string length adjustment device in accordance with a fourth embodiment of the present invention.

Although the latches 124 are fixed to the rotation housing 120 in the embodiments described above, the individual latches 224 may be separately manufactured and individually coupled as shown in FIG. 8.

In this case, latch guides 225 for guiding the individual latches 224 need to be formed in the rotation housing 120, and pins 226 serving to prevent the individual latches 224 from being deviated may be further used if necessary. The pins 226 are optional and are not necessarily provided.

In the meantime, each of the individual latches 224 may include a first latch 224*a* interacting with the unidirectional sawtooth 113 of the fixed housing 110 side by being engaged with the unidirectional sawtooth, and a second latch 224*b* that is integrally formed with the first latch 224*a*, formed with a smaller thickness than that of the first latch 224*a* at one side of the first latch 224*a* for providing the first latch 224*a* with elastic restoration, and supported by the latch guide 225. As described above, since the second latches 224*b* are provided in the form of build-up parts, the individual latches 224 may return to respective original positions after the individual latches 224 are operated.

In the meantime, an individual latch deviation blocking portion 225*a* is formed on an inner wall of the latch guide 225, and is disposed between the first latch 224*a* and the second latch 224*b*, thereby acting to prevent the individual latch 224 from being deviated. In this case, the pins 226 may be excluded.

While some embodiments of the present invention have been illustrated and described, it will be understood by those skilled in the art that the present embodiments may be modified without departing from the principle or the spirit of the present invention. Accordingly, it should be understood that the scope of the present invention is not limited to the embodiments described herein but may be variously modified and changed without departing from the spirit and scope of the present invention. Such modified examples or changed examples are intended to be included in the scope of the present invention.

The invention claimed is:

1. A string length adjustment device comprising:

a fixed housing including a drum rotation axis formed in a central region thereof;

a rotation housing rotatably coupled with respect to the fixed housing;

a winding drum inserted into the fixed housing and the rotation housing and including a winding part around/from which a string is wound or unwound; and a coupling unit guide shaft coupling the fixed housing to the rotation housing, the coupling unit guide shaft guiding up/down operations of the rotation housing for operations of winding or unwinding the string, wherein the coupling unit guide shaft includes elastic ribs and protrusions, the elastic ribs being elastically biased in an outward radial direction and the protrusions being formed on the elastic ribs, and wherein the rotation housing includes protrusion supports formed on walls of a shaft insertion hole of the rotation housing to support the protrusions.

2. The string length adjustment device according to claim 1, wherein unidirectional sawteeth are disposed in any one of the fixed housing and the rotation housing in the direction in which the fixed housing and the rotation housing are coupled with each other, latches interacting with the unidirectional sawteeth by being selectively engaged with the unidirectional sawteeth so as to allow the string to be wound around or unwound from the winding drum are disposed in the other of fixed housing and the rotation housing in which the unidirectional sawteeth are not formed, housing coupling sawteeth are disposed in an annular shape in a lower region of the rotation housing, and drum coupling sawteeth interacting with the housing coupling sawteeth by being engaged with the housing coupling sawteeth are disposed in an annular shape in an upper region of the winding drum.

3. The string length adjustment device according to claim 2, wherein the housing coupling sawteeth and the drum coupling sawteeth are provided in the form of right triangle or obtuse triangle, and the housing coupling sawteeth and the drum coupling sawteeth are engaged with each other such that oblique sides are in contact with the respective corresponding sides and sides forming heights are in contact with the respective corresponding sides forming heights.

4. The string length adjustment device according to claim 3, wherein each of the coupling sawteeth has a flexibility allowing the coupling sawtooth to be elastically moved when an external force is applied to the coupling sawtooth.

5. The string length adjustment device according to claim 2, wherein when the rotation housing is pressed downward to allow the string to be wound, the latches are engaged with the unidirectional sawteeth, the rotation housing is rotated only in one direction, the housing coupling sawteeth of the rotation housing and the coupling sawteeth of the winding drum are firmly in close contact with each other to cause the winding drum to be integrally rotated when the rotation housing is rotated, and when the rotation housing is pulled upward to allow the string to be unwound, the latches are engaged with or spaced apart from the unidirectional sawteeth, the rotation housing is rotated in one direction or is rotated in a forward or reverse direction, and the housing coupling sawteeth of the rotation housing and the coupling sawteeth of the winding drum are completely spaced from each other so that an interference state is removed.

6. The string length adjustment device according to claim 2, wherein the drum coupling sawteeth comprise:

first drum coupling sawteeth shaped to allow the housing coupling sawteeth of the rotation housing to be rotated in either forward or reverse direction; and second drum coupling sawteeth disposed in lower regions of the first drum coupling sawteeth and shaped to be engaged with the housing coupling sawteeth so as to allow the rotation housing and the winding drum to be integrally rotated.

7. The string length adjustment device according to claim 2, wherein the unidirectional sawteeth are formed along an inner peripheral surface, an outer peripheral surface, or the top surface, and are shaped to allow the latches to be rotated in one direction.

8. The string length adjustment device according to claim 2, wherein free ends of the latches are shaped to be hooks that are elastically moved toward the inside of the radial direction or upward out of the top surface.

9. The string length adjustment device according to claim 1, wherein elastic restoration reinforcing portions for reinforcing elastic restoration of the elastic ribs are further provided in the elastic ribs.

10. The string length adjustment device according to claim 1, wherein the protrusions of the coupling unit guide shaft are disposed above the protrusion supports when the rotation housing is pressed toward the fixed housing so as to wind the string, and are disposed under the protrusion supports when the rotation housing is pulled upward so as to unwind the string.

11. The string length adjustment device according to claim 1, wherein two circular plates for maintaining the string position are disposed to be spaced from each other in the winding drum.

12. The string length adjustment device according to claim 1, wherein the coupling unit guide shaft includes a shaft and a screw, wherein the shaft is inserted from the rotation housing side and into the rotation axis of the fixed housing to prevent up/down movements of the winding drum, and the screw enables the rotation axis of the fixed housing and the shaft to be coupled and fixed to each other.

13. The string length adjustment device according to claim 1, wherein the rotation housing further includes a number of individual latches and latch guides for guiding the individual latches, wherein the individual latches are separately made to be engaged with the sawteeth of the fixed housing side and are coupled to the rotation housing side.

14. The string length adjustment device according to claim 13, wherein each of the individual latches includes a first latch interacting with the sawtooth of the fixed housing side by being engaged with the sawtooth, and a second latch that is integrally formed with the first latch, formed to have a smaller thickness than the first latch at one side of the first latch for providing the first latch with elastic restoration, and supported by the latch guide.

15. The string length adjustment device according to claim 14, wherein an individual latch deviation blocking portion is further formed on an inner wall of the latch guide and is disposed between the first latch and the second latch to prevent the individual latches from being deviated.

* * * * *